US006622815B2

(12) United States Patent
Kolpe et al.

(10) Patent No.: US 6,622,815 B2
(45) Date of Patent: Sep. 23, 2003

(54) TRANSDUCER SUPPORT PAD

(75) Inventors: Vasant V. Kolpe, Mendota Heights, MN (US); Martin P. Babcock, White Bear Lake, MN (US); Robert J. Oliveira, Maplewood, MN (US)

(73) Assignee: Hearing Components, Inc., Oakdale, MN (US)

( * ) Notice: Subject to any disclaimer, the term of this patent is extended or adjusted under 35 U.S.C. 154(b) by 0 days.

(21) Appl. No.: 09/982,121

(22) Filed: Oct. 16, 2001

(65) Prior Publication Data

US 2003/0070868 A1 Apr. 17, 2003

(51) Int. Cl.[7] ..... H04R 25/02
(52) U.S. Cl. ..... 181/130; 181/135; 381/324
(58) Field of Search ..... 181/130, 135, 181/129, 137; 381/318, 324, 328, 353

(56) References Cited

U.S. PATENT DOCUMENTS 3,728,562 A * 4/1973 Herson et al. ..... 310/326
4,763,752 A * 8/1988 Haertl et al. ..... 181/130
4,854,415 A * 8/1989 Goschke ..... 181/130
4,969,534 A 11/1990 Kolpe et al.
5,664,020 A * 9/1997 Goldfarb et al. ..... 381/89
6,456,720 B1 * 9/2002 Brimhall et al. ..... 381/324
6,459,800 B1 * 10/2002 Brimhall ..... 381/324

* cited by examiner

*Primary Examiner*—Robert E. Nappi
*Assistant Examiner*—David S. Warren
(74) *Attorney, Agent, or Firm*—Crompton, Seager & Tufte, LLC

(57) ABSTRACT

A support pad for use in a hearing device of the type comprising a casing having an inner surface defining a cavity; and a sound receiving, amplification and transmitting system within the cavity in the casing, which system includes a transducer. The support pad includes a layer of conformable metal having first and second opposite major surfaces, and a layer of viscoelastic material along its first major surface. The support pad has an attachment portion with the layer of viscoelastic material along the attachment portion being adapted to be adhered to a side surface of the transducer, and has at least one tab portion adapted to project away from the transducer adjacent an end of the transducer. The tab portion is adapted to be shaped so that the second major surface along the tab portion is adjacent and conforms to the inner surface of the casing and can be adhered to the inner surface of the casing with the tab portion shaped and positioned so that the attachment portion of the support pad and the transducer are spaced from the inner surface of the casing.

20 Claims, 1 Drawing Sheet

TRANSDUCER SUPPORT PAD

FIELD OF THE INVENTION

This invention concerns hearing devices (particularly including hearing aids) and their assembly, and is especially concerned with the long-felt need to minimize or avoid the unwanted cascading amplification (i.e., feedback) caused by vibrations of either the casing or the components of hearing devices, particularly including the hearing aid.

BACKGROUND OF THE INVENTION

Hearing aids, particularly in-the-ear and in-the-canal aids, have become exceedingly small. The casing of such a hearing aid usually contains electrical components including a microphone, an amplifier, and a loudspeaker assembly (usually called a "receiver"), which, because of their tiny size, are both delicate and difficult to handle. The close proximity of the microphone and receiver in the casing makes it difficult to avoid acoustic feedback.

U.S. Pat. No. 4,969,534, incorporated herein by reference, describes a hearing aid that employs a viscoelastic material to adhere components to the casing of the hearing aid, describes other prior art attempts to reduce amplification of noise by a hearing aid and to facilitate their assembly, and describes and identifies other prior art.

A currently used method for making a custom in-the-canal hearing aid for a person includes pouring pre-polymerized silicone rubber into the ear canal of the person and allowing it to solidify into a molding having the same outer shape as the inner shape of that ear canal. Agar or a different silicone rubber is poured around that molding after it is removed from the ear canal to make a receptacle with a cavity having an inner surface of the same shape as the person's ear canal. After removing the molding from the cavity, a layer of methyl methacrylate pre-polymer resin is poured along the inner surface defining that cavity. That layer is solidified to provide a portion of a casing for the custom hearing aid that has a custom irregular outer surface shaped to be closely received in that person's ear canal, has an irregular inner surface generally corresponding to its outer surface that defines a cavity, and has an access opening to that cavity. A through opening is formed between the inner and outer surfaces of the casing in a portion of the casing that will be received innermost in the ear canal. A sound receiving, amplification and transmitting system is mounted within the cavity in the casing. That system includes components mounted on a faceplate of a material that is compatible with the material of the casing, which faceplate is adapted to be permanently attached across the access opening to the cavity in the casing. Those components on the faceplate are attached by electrical connections to a loudspeaker assembly called a receiver having a sound outlet opening in a first end of the receiver. A tube of resiliently flexible material having a through passageway between opposite first and second ends has a portion adjacent its first end engaged around the receiver from its first end to a second opposite end of the receiver with the sound outlet opening of the receiver communicating with the passageway, and has the second end of the tube positioned through opening in the casing. The faceplate is permanently attached across the access opening to the cavity, leaving the receiver supported in the cavity by the tube and the electrical connections from the components of the system mounted on the faceplate. The system is then activated, while a technician listens to the system with a stethoscope at the second end of the tube and determines from the quality of sound emanating from that tube whether the receiver is supported without significant contact with the casing or other components in the cavity, for if it is not a significant amount of amplified noise and feedback will be heard. If such is the case, the technician will relocate the receiver in the cavity by manipulating the tube (e.g., by pulling or pushing on the tube and/or rotating it about its axis) until a position for the receiver is found where it will not have significant contact with the casing or other components in the cavity, whereupon the second end of the tube is secured to the casing to maintain that position. This adjustment can take a significant amount of time and can significantly add to the cost of producing the custom hearing aid. Such support for the receiver isolates its vibrations from the casing and other components in the cavity, but provides little damping of the vibrations from the receiver.

DISCLOSURE OF THE INVENTION

The present invention provides a method for mounting a transducer particularly including a receiver in a hearing device such as a hearing aid (particularly including a custom in-the-ear hearing aid generally of the type described above) using a special support pad that can provide placement of and support for the receiver that will restrict the amount of feedback that will be produced without the need to position the receiver in the casing using the technique described above.

The support pad according to the present invention can be used in a hearing aid (e.g., a custom in-the-ear hearing aid) of the type comprising (1) a molded casing having an irregular outer surface shaped to be received in a person's ear canal, having an inner surface defining a cavity, and having a through opening between its inner and outer surfaces in a portion of the casing to be received innermost in the ear canal; (2) a sound receiving, amplification and transmitting system within the cavity in the casing, which system includes a speaker assembly or receiver having a sound outlet opening in a first end of the receiver; and (3) a tube of resiliently flexible material having first and second ends, and a through passageway between those ends, the first end of the tube engaging the receiver with the sound outlet opening communicating with the passageway, and the second end being engaged with (e.g., pressed against or attached to) the casing at the through opening with the passageway communicating through the outer surface of the casing. The support pad includes a layer of conformable or ductile metal (e.g., aluminum) having first and second opposite major surfaces, and a layer of viscoelastic material along its first major surface. The support pad has an attachment portion with the layer of viscoelastic material along the attachment portion being adapted to be adhered to a side surface of the receiver, and has at least one tab portion adapted to project away from the receiver adjacent a second end of the receiver opposite its first end. The tab portion is adapted to be shaped so that the second major surface along the tab portion is adjacent and conforms to the inner surface of the casing and can be adhered to the inner surface of the casing with the tab portion shaped and positioned so that the first end of the receiver is against the first end of the tube and so that the attachment portion of the support pad and the receiver are spaced from the inner surface of the casing.

Such support for the receiver provides vibration isolation because the receiver does not touch the casing and is only mounted on the casing by the layer of viscoelastic material by which it is adhered to the support pad and its contact with the resiliently flexible tube through which it emits sound, and also provides vibration damping because of the vibration damping properties of that viscoelastic material.

The layer of conformable metal should be easy to bend, and should retain a shape to which it is bent. By "conformable metal", we mean a metal which yields to retain a shape to which it is bent without recoil. A suitable layer of conformable metal is of aluminum having a thickness in the range of 0.002 to 0.007 inch or 0.005 to 0.018 cm, and preferably having a thickness in the range of 0.004 to 0.005 inch or 0.010 to 0.013 cm. Other suitable but more expensive conformable metals could include copper and gold.

The layer of viscoelastic material should have a thickness of at least 0.002 inch or 0.005 cm, and preferably has a thickness of at least 0.007 inch or 0.018 cm (e.g., 0.012 inch or 0.03 cm) which allows it to more easily conform to the side surface of the receiver. The layer of viscoelastic material should have the properties of the viscoelastic material described in U.S. Pat. No. 4,969,534, the content of which patent is hereby incorporated herein by reference, including that at a frequency of 1000 Hz and a temperature of 38 degrees centigrade, the viscoelastic material will produce a dynamic shear loss modulus G" of at least $0.5\times10^7$ dynes/$cm^2$, and preferably that at a frequency of 1000 Hz and a temperature of 38 degrees centigrade, the viscoelastic material will produce a dynamic shear loss modulus G" of at least $1.5\times10^7$ dynes/$cm^2$. Also, the viscoelastic material should be tacky as described in U.S. Pat. No. 4,969,534 to allow it to be adhered to a surface such as the surface of the receiver in the manner of a pressure sensitive adhesive. Advances in the art of viscoelastic materials now provide access to iron free viscoelastic materials which should be useful as the layer of viscoelastic material on the support pad to restrict corrosion when the support pad is used in the moist environment of a hearing aid.

The support pad can include two tab portions, each adapted to projecting away from the second end of the receiver and from a different edge of the side surface of that receiver, which tab portions are each adapted to be shaped so that the second major surface of the layer of metal along the tab portion is adjacent and conforms to the inner surface of the casing and can be adhered to that inner surface of the casing. The use of two such tab portions provides more possible locations along the inner surface of the casing at which a person assembling the hearing aid can adhere at least one of the tab portions to support the receiver.

Also, the support pad can further include a layer of polymeric material adhered over the surface of the layer of viscoelastic material opposite the layer of soft metal on its tab portion or portions. This layer of polymeric material will allow a person assembling the hearing aid to use an implement such as a tweezers to shape the tab portion so that the second major surface along the tab portion is adjacent and conforms to the inner surface of the casing without having the end of the implement stick to the layer of viscoelastic material.

BRIEF DESCRIPTION OF THE DRAWINGS

The present invention will be further described with reference to the accompanying drawing wherein like parts are identified with like reference numerals in the several views, and wherein.

DETAILED DESCRIPTION OF THE INVENTION

Figure 1:
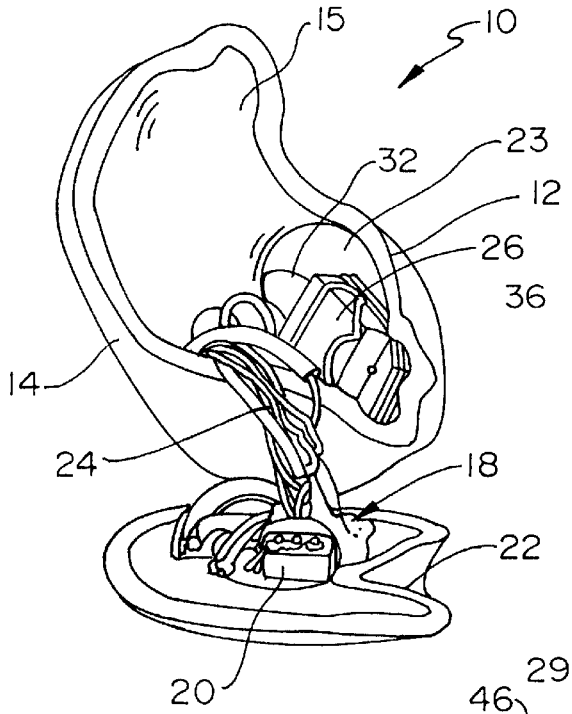
FIG. 1 is a perspective view of a hearing device or hearing aid according to the present invention in which a faceplate of the hearing aid is removed to show details.
Figure 2:
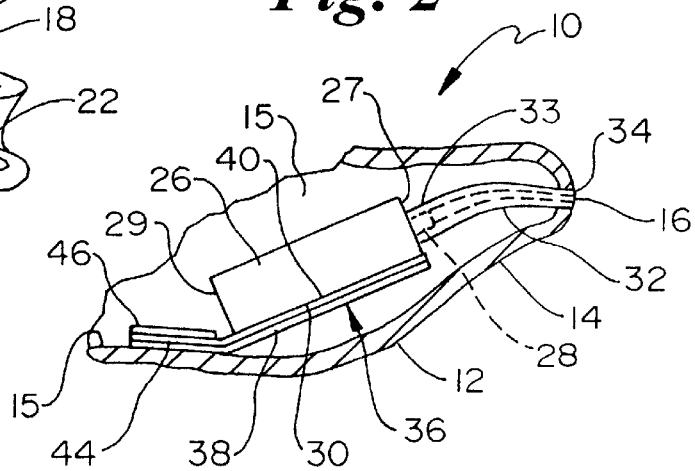
FIG. 2 is an enlarged fragmentary sectioned view of the hearing aid of FIG. 1.

Referring now to FIGS. 1 and 2 of the drawing, there is shown a hearing device or hearing aid according to the present invention generally designated by the reference numeral 10. Generally, the hearing aid 10 comprises a molded casing 12 (e.g., a casing of poly methyl methacrylate resin for a custom in-the-canal hearing aid molded in the known manner described above in the "Background of the Invention"). The casing 12 has an irregular outer surface 14 shaped to be closely received in a person's ear canal, has an irregular inner surface 15 that generally corresponds to its outer surface 14 that defines a cavity, and has a through opening 16 between its inner and outer surfaces 15 and 14 in a portion of the casing 12 adapted to be received innermost in the ear canal. Also, the hearing aid 10 includes a sound receiving, amplification and transmitting system 18 within the cavity in the casing 12, which system 18 includes components 20 (e.g., a battery housing, microphone, amplifier, and volume control) mounted on a face plate 22 of material compatible with the material of the casing 12 that, to complete assembly of the hearing aid 10, will be permanently attached or adhered across an access opening 23 to the cavity in the casing 12. The components 20 are attached by electrical connections 24 to a portion of the system 18 within the cavity comprising a loudspeaker assembly or receiver 26. The receiver 26 has a first end 27, a sound outlet opening 28 in its first end 27, an opposite second end 29, and a side surface 30 extending between its first and second ends 27 and 29. A tube 32 of resiliently flexible material (e.g., "FLEXAN"®, available from Felxan Corporation, Chicago, Ill.) having a through passageway between opposite first and second ends 33 and 34 has its first end engaged around a cylindrical projection around the sound outlet opening 28 in the receiver 26 with the sound outlet opening 28 communicating with the passageway, and its second end 34 attached by a suitable adhesive to the casing 12 at the through opening 16 in the casing 12 with the passageway of the tube 32 communicating through the outer surface 14 of the casing 12. A support pad 36 for the receiver 26 includes a layer 38 of conformable metal (e.g., 0.005 inch or 0.013 cm thick aluminum) having first and second opposite major surfaces and a layer 40 of viscoelastic material along its first major surface. Preferably, the support pad 36 is made from a length of the tape commercially designated "434 viscoelastic damping tape" that is available from Minnesota Mining and Manufacturing Company, St. Paul, Minn., and comprises a 0.0055 inch or 0.014 cm thick layer of aluminum coated with a 0.002 inch or 0.005 cm thick layer of viscoelastic material having an operating temperature range of from −60 to +20 degrees C.; which layer of viscoelastic material on the tape is over coated with two layers of 0.005 inch or 0.013 cm thick viscoelastic material commercially designated "112 viscoelastic damping polymer" available from Minnesota Mining and Manufacturing Company, St. Paul, Minn., which has an operating temperature range of from 0 to +65 degrees C.; thereby providing a 0.012 inch or 0.03 cm thick layer 40 of viscoelastic material that has an effective operating range of from −60 to +65 degrees C.

Figure 3:
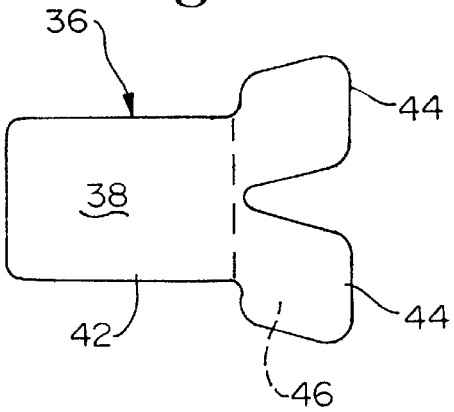
FIG. 3 is a much enlarged plan view of a support pad according to the present invention included in the hearing aid of FIGS. 1 and 2.
Figure 4:
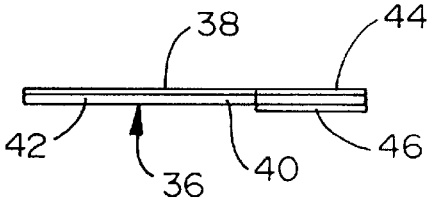
FIG. 4 is a side view of the support pad shown in FIG. 3.

As may be most easily understood by added reference to FIGS. 3 and 4 which show the support pad 36 before it is inserted in the hearing aid 10, the support pad 36 has a generally rectangular attachment portion 42 with the layer 40 of viscoelastic material along the attachment portion 42 being adhered to the side surface 30 of the receiver 26 by the tacky property of the viscoelastic material. The support pad 36 also has two tab portions 44 projecting away from the receiver 26 adjacent the second end 29 of the receiver 26. The tab portions 44 are each shaped so that the second major surface of the layer 38 of aluminum along at least one of the tab portions 44 is adjacent and conforms to the inner surface 15 of the casing 12. A layer of hard inflexible adhesive (which could be a photo initiated curing adhesive or a high viscosity cynoacrylate adhesive such as the adhesive commercially designated "Locktite 420" commercially available from Locktite Corporation, Rocky Hill, Conn.) adheres that second major surface along that tab portion 44 to the inner surface 15 of the casing 12. That tab portion 44 is shaped and positioned so that the first end 27 of the receiver 26 is positioned and supported against the first end 33 of the tube 32 with the attachment portion 42 of the support pad 36 and the receiver 26 spaced from the inner surface 15 of the casing 12 and from any other of the components 20 in the cavity.

When the receiver 26 is adhered to the attachment portion 42 of the support pad 36, the two tab portions 44 each project away from the second end 29 of the receiver 26 and from a different edge of the side surface 30 of the receiver 26 which provides more possible locations along the irregular inner surface 15 of the casing 12 at which a person assembling the hearing aid can adhere at least one of the tab portions 44 to support the receiver 26 at a desired location in the cavity of the casing 12.

As is seen in FIGS. 3 and 4, the support pad 36 includes a layer 46 of polymeric material with acceptable non-release characteristics (e.g., 0.003 inch or 0.008 cm thick PVC) adhered over the surface of the layer 40 of viscoelastic material opposite the layer of soft metal 38 on its tab portions 44. This layer 46 of polymeric material will allow a person assembling the hearing aid 10 to use an implement such as a tweezers to shape one of the tab portions 44 so that the second major surface of the layer of metal 38 along the tab portion 44 is adjacent and conforms to the inner surface 15 of the casing 12 without having the end of the implement stick to the layer 40 of viscoelastic material.

To assemble the hearing aid 10, a person can provide the molded casing 12 (which casing 12 can be custom made in the known manner described above in the "Background of the Invention") together with the sound receiving, amplification and transmitting system 18 to be positioned within the cavity in the casing 12 which is commercially available with various amplification characteristics and with the components 20 already mounted on the face plate 22 that is adapted to be adhered to the casing 12 over the access opening 23, together with the receiver 26. The tube 32 is also provided with its first end 33 that is adapted to engage the first end of the receiver 26, together with the support pad 36 according to the present invention. The first end 33 of the tube 32 is fixed around the cylindrical projection around the sound outlet opening 28 on the receiver 26 so that the sound outlet opening 28 communicates with the passageway through the tube 32. The attachment portion 42 of the support pad 36 is adhered to the side surface 30 of the receiver 26 by pressing the tacky layer 40 of viscoelastic material against it. The second end 34 of the tube 32 is attached to the casing 12 at the through opening 16 with the passageway in the tube 32 communicating through the outer surface 14 of the casing 12. At least one (and possibly both) of the tab portions 44 is positioned and shaped so that the first end 27 of the receiver 26 is positioned against the first end 33 of the tube 32 with the attachment portion 42 of the support pad 36 and the receiver 26 spaced from the inner surface 15 of the casing 12 and so that the second major surface on the metal layer 38 along the tab portion 44 is adjacent and conforms to the inner surface 15 of the casing 12; and that second major surface along the tab portion 44 is adhered to the inner surface 15 of the casing 12. The faceplate 22 is then adhered over the access opening 23 to the cavity to complete the assembly of the hearing aid 10.

Such positioning and shaping of one or both of the tab portions 44 typically requires bending of the tab portions 44 and/or bending of the support pad 36 between the attachment portion 42 and the tab portion 44, and can be done using an implement such as an industrial tweezers, whereupon the layers 46 of polymeric material on the tab portions 44 will restrict adhesion of the end of the implement to the layer 40 of viscoelastic material. If desired because of space limitations or for other reasons, one of the two tab portions 44 can be cut away and discarded.

The present invention has now been described with reference to one embodiment and several modifications thereof. It will be apparent to those skilled in the art that many changes can be made in the embodiment described without departing from the scope of the present invention. For example, The relative size and shapes of the tab portions 44 on the support pad 36 could be changed to meet certain production conditions, and for some uses, providing only one tab portion on the support pad 36 may be useful or desirable. Also, the tube 32 could have other than a cylindrical outer surface, such as, for example, a mushroom shaped outer surface for engaging the inner surface 15 of the casing 12 with the through opening in the tube 32 aligned with the through opening 16 in the casing 12. The support pad 36 would be useful on casings having inner surfaces that are generally planar rather than irregular. The support pad 36 could be useful for supporting transducers (i.e., the term "transducer" encompasses a receiver or a microphone or a module containing both a receiver and a microphone) in any type of hearing device such as any of the many types of hearing aids intended for short term or extended term use, as well as other hearing devices subject to problems arising from internal vibrations such as cell phones, walky-talkies, etc. Thus, the scope of the present invention should not be limited to the structures described in this application, but only by the structures described by the language of the claims and the equivalents thereof.

What is claimed is:

1. A hearing aid comprising:

a molded casing having an irregular outer surface shaped to be received in a person's ear canal, having an inner surface defining a cavity, and having a through opening between said inner and outer surfaces in a portion of the casing to be received innermost in the ear canal;

a sound receiving, amplification and transmitting system within said cavity in the casing, said system including a receiver having a first end with a sound outlet opening in said first end, a second opposite end, and a side surface extending between said first and second ends;

a tube of resiliently flexible material having first and second ends, and a through passageway between said ends, said first end engaging said receiver with said sound outlet opening communicating with said passageway, and said second end engaging said casing at said through opening with said passageway communicating through the outer surface of said casing;

a support pad comprising a layer of conformable metal having first and second opposite major surfaces and a layer of viscoelastic material along said first major surface, said support pad having an attachment portion with the layer of viscoelastic material along said attachment portion being adhered to the side surface of said receiver, and at least one tab portion projecting away from said receiver adjacent said second end of said receiver, said tab portion being shaped so that said second major surface along said tab portion is adjacent and conforms to the inner surface of said casing; and a layer of adhesive adhering said second major surface along said tab portion to the inner surface of said casing;

said tab portion being shaped and positioned so that the first end of said receiver is against the first end of said tube with said attachment portion of said support pad and said receiver being spaced from the inner surface of said casing.

2. A hearing aid according to claim 1, wherein said support pad comprises two tab portions each projecting away from said second end of said receiver and from a different edge of the side surface of said receiver, said tab portions each being shaped so that said second major surface along said tab portion is adjacent and conforms to the inner surface of said casing; and said layer of adhesive adheres the second major surface along each of said tab portions to the inner surface of said casing.

3. A hearing aid according to claim 1, wherein the layer of conformable metal is of aluminum having a thickness in the range of 0.002 to 0.007 inch or 0.005 to 0.018 cm.

4. A hearing aid according to claim 1, wherein the layer of viscoelastic material has a thickness of at least 0.002 inch or 0.005 cm and, at a frequency of 1000 Hz and a temperature of 38 degrees centigrade, will produce a dynamic shear loss modulus G" of at least $0.5\times10^7$ dynes/cm$^2$.

5. A hearing aid according to claim 1, wherein the layer of viscoelastic material has a thickness of about 0.012 inch or 0.03 cm and, at a frequency of 1000 Hz and a temperature of 38 degrees centigrade, will produce a dynamic shear loss modulus G" of at least $1.5\times10^7$ dynes/cm$^2$.

6. A hearing aid according to claim 1, wherein the layer of viscoelastic material has an effective operating range of from −60 to +65 degrees C.

7. A support pad for use in a hearing aid of the type comprising:

a molded casing having an irregular outer surface shaped to be received in a person's ear canal, having an inner surface defining a cavity, and having a through opening between said inner and outer surfaces in a portion of the casing to be received innermost in the ear canal;

a sound receiving, amplification and transmitting system within said cavity in the casing, said system including a receiver having a first end, a sound outlet opening in said first end, a second opposite end, and a side surface extending between said first and second ends; and a tube of resiliently flexible material having first and second ends, and a through passageway between said ends, said first end engaging said receiver with said sound outlet opening communicating with said passageway, and said second end engaging said casing at said through opening with said passageway communicating through the outer surface of said casing;

said a support pad comprising a layer of conformable metal having first and second opposite major surfaces and a layer of viscoelastic material along said first major surface, said support pad having an attachment portion with the layer of viscoelastic material along said attachment portion being adapted to be adhered to the side surface of said receiver, and having at least one tab portion adapted to project away from the receiver adjacent said second end of the receiver, said tab portion being adapted to be shaped so that said second major surface along said tab portion is adjacent and conforms to the inner surface of said casing and can be adhered to the inner surface of said casing with said tab portion shaped and positioned so that the first end of said receiver is against the first end of said tube and so that said attachment portion of said support pad and said receiver are spaced from the inner surface of said casing.

8. A support pad according to claim 7, comprising two tab portions each adapted to projecting away from said second end of said receiver and from a different edge of the side surface of said receiver, said tab portions each being adapted to be shaped so that said second major surface along said tab portion is adjacent and conforms to the inner surface of said casing; and can be adhered to the inner surface of the casing.

9. A support pad according to claim 8, further including a layer of polymeric material adhered over the surface of the layer of viscoelastic material opposite the layer of soft metal on said tab portion.

10. A support pad according to claim 7, further including a layer of polymeric material adhered over the surface of the layer of viscoelastic material opposite the layer of soft metal on said tab portions.

11. A hearing aid according to claim 7, wherein the layer of conformable metal is of aluminum having a thickness in the range of 0.002 to 0.007 inch or 0.005 to 0.018 cm.

12. A hearing aid according to claim 7, wherein the layer of viscoelastic material has a thickness of at least 0.002 inch or 0.005 cm and, at a frequency of 1000 Hz and a temperature of 38 degrees centigrade, will produce a dynamic shear loss modulus G" of at least $0.5\times10^7$ dynes/cm$^2$.

13. A hearing aid according to claim 7, wherein the layer of viscoelastic material has a thickness of about 0.012 inch or 0.03 cm and, at a frequency of 1000 Hz and a temperature of 38 degrees centigrade, will produce a dynamic shear loss modulus G" of at least $1.5\times10^7$ dynes/cm$^2$.

14. A method for assembling a hearing aid comprising the steps of:

providing a molded casing having an irregular outer surface shaped to be received in a person's ear canal, having an inner surface defining a cavity, and having a through opening between the inner and outer surfaces in a portion of the casing to be received innermost in the ear canal;

providing a sound receiving, amplification and transmitting system to be positioned within the cavity in the casing, the system including a receiver having a first end with a sound outlet opening in said first end, a second opposite end, and a side surface extending between the first and second ends;

providing a tube of resiliently flexible material having first and second ends, and a through passageway between the ends;

providing a support pad comprising a layer of conformable metal having first and second opposite major surfaces and a layer of viscoelastic material along the first major surface, the support pad having an attachment portion with the layer of viscoelastic material along said attachment portion being adapted to be adhered to the side surface of the receiver, and having at least one tab portion adapted to project away from the receiver adjacent the second end of the receiver, engaging the first end of the tube with the receiver with the sound outlet opening communicating with the passageway;

engaging the second end of the tube with the casing at the through opening with the passageway communicating through the outer surface of the casing;

adhering the layer of viscoelastic material along the attachment portion to the side surface of the receiver;

positioning and shaping the tab portion so that the first end of the receiver is positioned against the first end of the tube with the attachment portion of the support pad and the receiver being spaced from the inner surface of the casing and so that the second major surface along the tab portion is adjacent and conforms to the inner surface of the casing; and adhering the second major surface along the tab portion to the inner surface of the casing.

15. A method according to claim 14, wherein the support pad comprises two tab portions each after the adhering step projecting away from the second end of the receiver and from a different edge of the side surface of the receiver, and the method includes shaping at least one of the tab portions so that the second major surface along the tab portion is adjacent and conforms to the inner surface of the casing; and adhering the second major surface along the at least one of the tab portions to the inner surface of the casing.

16. A hearing device comprising:

a casing having an inner surface defining a cavity;

a sound receiving, amplification and transmitting system within said cavity in the casing, said system including a transducer having a side surface extending between first and second ends;

a support pad comprising a layer of metal having first and second opposite major surfaces and a layer of viscoelastic material along said first major surface, said support pad having an attachment portion with the layer of viscoelastic material along said attachment portion being adhered to the side surface of said transducer, and at least one tab portion projecting away from said transducer adjacent said second end of said transducer, said tab portion being shaped so that said second major surface along said tab portion is adjacent and conforms to the inner surface of said casing; and a layer of adhesive adhering said second major surface along said tab portion to the inner surface of said casing;

said tab portion being shaped and positioned so that said attachment portion of said support pad and said receiver are spaced from the inner surface of said casing.

17. A hearing device according to claim 16, wherein said support pad comprises two tab portions each projecting away from said second end of said transducer and from a different edge of a side surface of said transducer, said tab portions each being shaped so that said second major surface along said tab portion is adjacent and conforms to the inner surface of said casing; and said layer of adhesive adheres the second major surface along each of said tab portions to the inner surface of said casing.

18. A hearing aid according to claim 16, wherein the layer of metal is of conformable aluminum having a thickness in the range of 0.002 to 0.007 inch or 0.005 to 0.018 cm.

19. A hearing aid according to claim 16, wherein the layer of viscoelastic material has a thickness of at least 0.002 inch or 0.005 cm and, at a frequency of 1000 Hz and a temperature of 38 degrees centigrade, will produce a dynamic shear loss modulus G" of at least $0.5\times10^7$ dynes/cm$^2$.

20. A hearing aid according to claim 16, wherein the layer of viscoelastic material has a thickness of about 0.012 inch or 0.03 cm and, at a frequency of 1000 Hz and a temperature of 38 degrees centigrade, will produce a dynamic shear loss modulus G" of at least $1.5\times10^7$ dynes/cm, and wherein the layer of viscoelastic material has an effective operating range of from −60 to +65 degrees C.

* * * * *